US006252149B1

(12) United States Patent
Matsushita

(10) Patent No.: US 6,252,149 B1
(45) Date of Patent: Jun. 26, 2001

(54) FINGER PLATE FOR A STRINGED INSTRUMENT

(75) Inventor: Tatsuya Matsushita, Kanagawa (JP)

(73) Assignee: Sanko Seisakusho Co., Ltd., Kanagawa (JP)

( * ) Notice: Subject to any disclaimer, the term of this patent is extended or adjusted under 35 U.S.C. 154(b) by 0 days.

(21) Appl. No.: 09/517,289

(22) Filed: Mar. 2, 2000

(30) Foreign Application Priority Data

Oct. 6, 1999 (JP) ..... 11-321548
Nov. 29, 1999 (JP) ..... 11-337952

(51) Int. Cl.[7] ..... G10D 3/06
(52) U.S. Cl. ..... 84/314 R; 84/314 N; 84/315
(58) Field of Search ..... 84/267, 268, 299, 84/274, 290, 314 R, 314 N, 315

(56) References Cited

U.S. PATENT DOCUMENTS 4,620,470 * 11/1986 Vogt ..... 84/314 R
5,085,115 * 2/1992 Schlink ..... 84/310
5,852,249 * 12/1998 Steinberg et al. ..... 84/293
5,952,593 * 9/1999 Wilder ..... 84/314 R
6,034,310 * 3/2000 Kolano ..... 84/293
6,069,306 * 5/2000 Isvan et al. ..... 84/267

* cited by examiner

*Primary Examiner*—Robert E. Nappi
*Assistant Examiner*—Kim Lockett
(74) *Attorney, Agent, or Firm*—Wenderoth, Lind & Ponack, L.L.P.

(57) ABSTRACT

In a finger plate for a stringed instrument, the frets are formed arcuately and have a center of curvature through which some extending lines of strings pass, so that lengths of the strings between adjacent frets are made equal and every string crosses every fret perpendicularly. As a result, exact musical interval can be attained.

18 Claims, 5 Drawing Sheets

FINGER PLATE FOR A STRINGED INSTRUMENT

BACKGROUND OF THE INVENTION

This invention relates to a finger plate used in stringed instruments, such as guitars, mandolins and ukuleles, having frets which are located corresponding to musical intervals.

As shown in FIG. 5, a prior finger plate for a stringed instrument, for instance, a finger plate for a guitar 100 is constituted by a finger plate main body 108, a nut (or an upper nut) 107 which holds one end of each of six strings 101–106, and a plurality of frets 111 each of which is provided on the finger plate main body 108 with a specific distance from the nut 107 and in parallel with the nut 107. Note that a zero fret 110 is formed on the inside surface of the nut 107.

The above specific distance is, based on the position where each of the frets 111 is formed. The positions are between the surface of the nut 107 and a saddle (a lower nut), not shown in the figures which holds the other end of each of the plural strings 101–106, and are determined by calculating temperament of natural scale on the finger plate at the zero fret 110.

In regard to this constitution, Japanese Utility Model Registration No. 3,012,510 discloses a stringed instrument which has a plurality of frets which constitute parts of radii extending from the same center point, with especially one fret located in a center of the finger plate being perpendicular to a longitudinal axis of the finger plate. Japanese Unexamined Patent Publication No. 8-83064 discloses a guitar for which metallic parts of the frets are slanted so that the frets are not in parallel to one another.

However, as shown in FIG. 6, distances L1'–L6' between frets 111 in each of strings 101–106 become longer from a center toward both outer sides, and angles $\alpha$1–$\alpha$6 between each of strings 101–106 and each of the frets 111 become larger from the center toward both outer sides, so that the strings 103 and 104 located in the center and the strings 101 and 106 located at both outer sides are significantly different in distance from the zero fret 110. As a result, though the frets 111 are located in correct positions calculated by the original temperament, there may be a bad condition such that it is difficult to obtain strict musical intervals.

Furthermore, when the strings cross the frets obliquely, one side of the string has obtuse angles with the frets and the other side of it has acute angles with the frets. As a result, the one side is free against vibration of the string, but the other side is not free against vibration of the string is arisen, which is a bad condition preventing the string from being vibrated accurately. Thus, in all of the above devices, because the frets and the strings do not cross each other perpendicularly, they have the above bad conditions.

Moreover, the above bad conditions are especially apparent when plural strings are pressed down in order to play a chord. In other words, because each pitch gap of the strings is different from one another in the strings and the positions pressed down, so that a discord different from the original chord constitution is added to the sound condition of the chord. As a result, there is a problem in that it is difficult to obtain an exact musical interval and a good balance.

Furthermore, in prior instruments such that the frets are arranged in parallel with one another, because grooves in which the frets are mounted are formed in parallel with one another, they would have a disadvantageous constitution with respect to the resistance to tension of the strings.

Namely, in the condition that drying of wood itself progresses, the grooves formed in parallel with one another are directly affected by the tension of the strings because each of the grooves is formed with a size with allowance in the width and the depth for a base portion of the fret. As a result, warping or twisting of a neck or the finger plate itself may occur disadvantageously.

SUMMARY OF THE INVENTION

Thus, this invention is to offer a finger plate for a stringed instrument provided with exact musical interval and a good balance of the musical intervals to solve the above disadvantages and problems.

Accordingly, a finger plate for a stringed instrument according to this invention comprises a finger plate main body; a nut positioned on one end portion of the finger plate main body for holding first ends of a plurality of strings which are put side by side, and being formed with a narrower width than a saddle holding second ends of the strings; and frets arranged on the finger plate main body at specific distances from the nut, respectively; wherein each of the frets is formed arcuately with a center of curvature at a position at which extending lines of both strings located on both outer sides of the plurality of strings intersect.

Therefore, according to this invention, because each of the frets is formed accurately as described above, the strings located on both outer sides, which have the largest gaps in the prior art, can cross every frets perpendicularly, so that an exact musical interval can be obtained and a balance of the musical intervals can be improved.

Furthermore, since mounting grooves are formed arcuately corresponding to the frets mounted therein, resistance of the fret grooves against tension of the strings can be increased relative to the prior fret grooves formed in parallel, so that stable cn be gained including resistance to deformation such as the warping or twisting due to drying.

Moreover, in the present invention, the specific distance is a distance calculated by each temperament from a zero fret which is an inside surface of the nut. Thus, each distance between frets is made to correspond to each distance of calculated temperament equal in the strings, respectively.

Furthermore, in the present invention, all extending lines of the plurality of the strings passes through the center point. Thus, because every string crosses every fret perpendicularly, an area in which the string contacts the fret can be made smaller, so that vibration of the string can become exact. As a result, a clear sound and an exact interval can be gained.

BRIEF EXPLANATION OF THE DRAWINGS

The above and other features of the invention and the concomitant advantages will be better understood and appreciated by persons skilled in the field to which the invention pertains in view of the following description given in conjunction with the accompanying drawings which illustrate a preferred embodiment. In the drawings.

THE PREFERRED EMBODIMENT

The following is an explanation of embodiments of the present invention with reference to the drawings. Though stringed instruments according to the present invention are guitars, ukuleles, mandolins, banjoes and so on, we explain about a case in which the present invention is applied to a guitar as follows.

Figure 1:
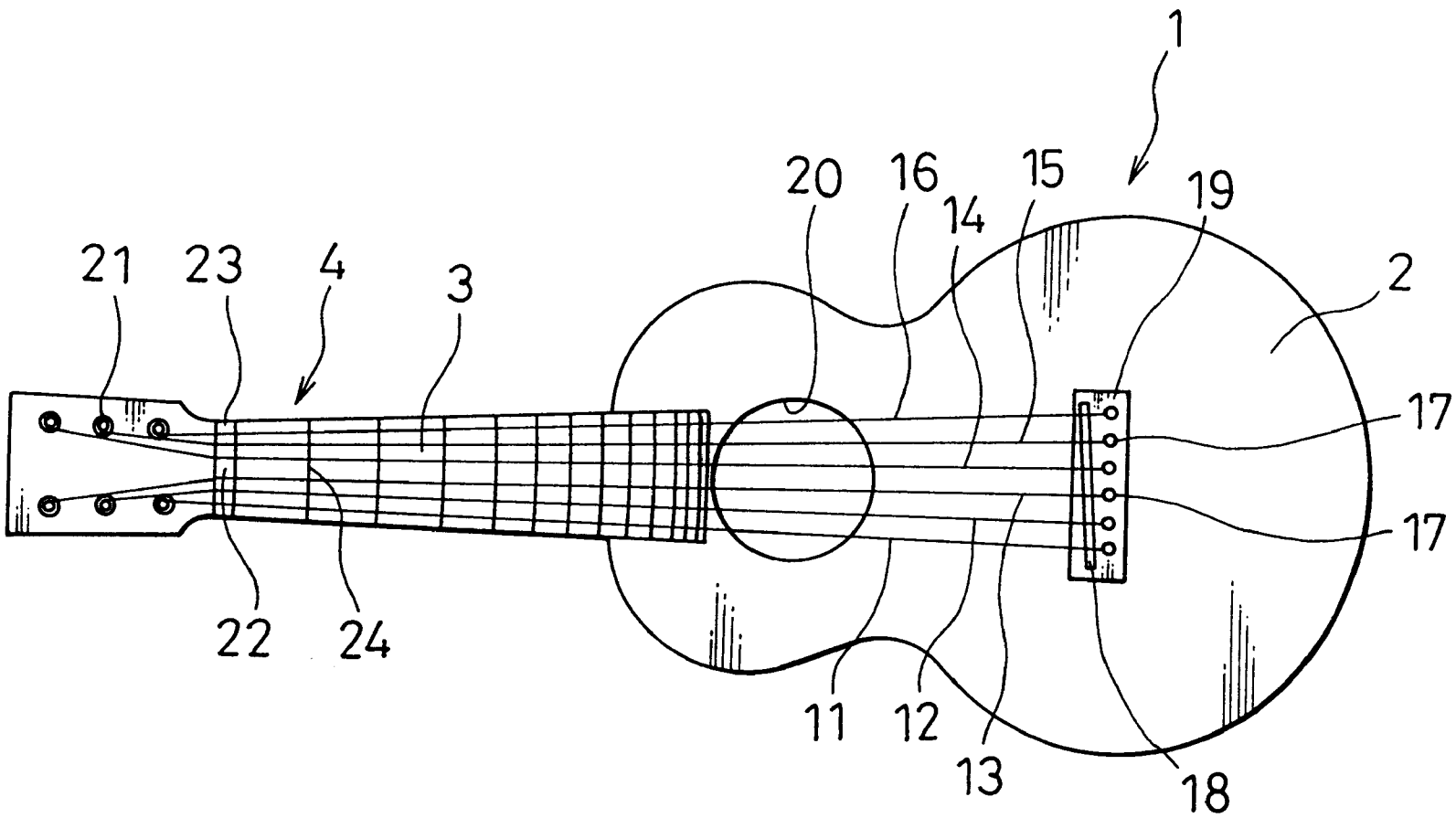
FIG. 1 is a schematic diagram of a guitar illustrating one example according to a working mode of this invention.

As shown in FIG. 1, a guitar 1 is constituted of a guitar main body 2 having a resonance space therein, a neck portion 4 having a finger plate 3 extending from the guitar main body 2 and strings 11–16 arranged at regular intervals.

The guitar main body 2 is provided with pins 17 each of which fixes a first end of each of of the strings 11–16, a pedestal 19 having a saddle 18 which holds the strings at a specific height in the vicinity of the first ends, and an opening portion 20 through which vibration of air produced by vibration of the strings 11–16 pass into the resonance space.

The neck portion 4 extends from the guitar main body 2 in the direction away from the pedestal 19. Six string winding portions 21 for winding second ends of the strings 11–16 are provided on an end portion of the neck portion 4. A nut 22 which holds the strings 11–16 at a specific height in the vicinity of the string winding portions 21 and which constitutes a part of the finger plate 3 is provided. Note that the nut 22 is formed with a narrower width than the saddle 18, and string mounting grooves 23 for mounting the strings 11–16, respectively, are formed at regular intervals in the nut 22.

The finger plate 3 extends from the nut 22 to the vicinity of the opening portion 20 and frets 24 are provided thereon.

Figure 2:
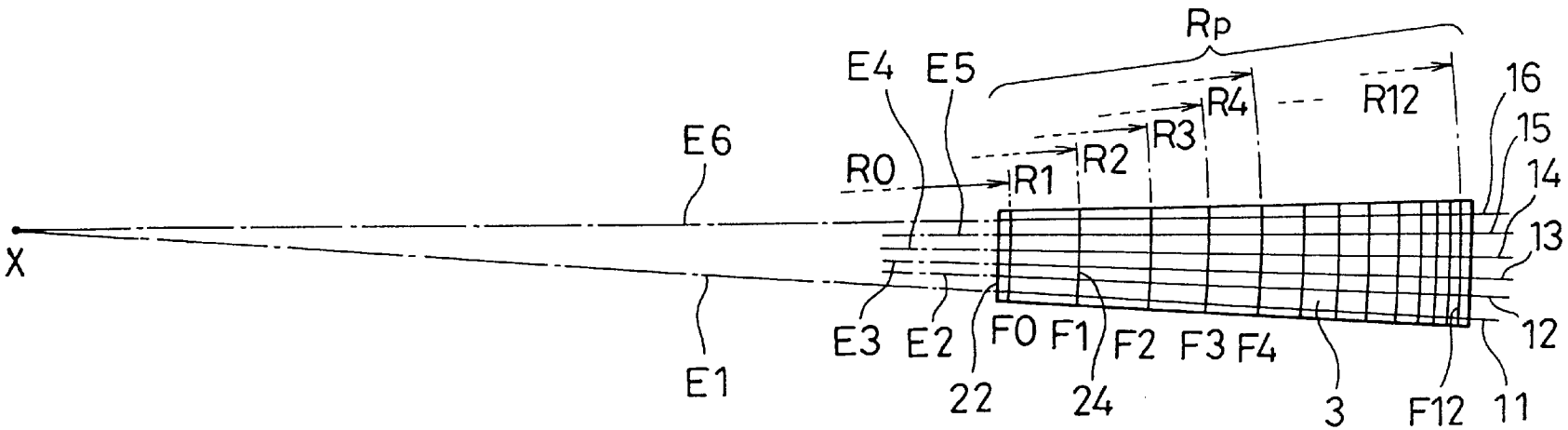
FIG. 2 is an illustration showing curvature radii of frets according to the working mode of this invention.

The frets 24 according to the present invention are, as shown in FIG. 2, formed arcuately with a radius Rp as a curvature radius from a point of intersection X of an extending line E1 of a first string 11 and an extending line E2 of a sixth string 16. Furthermore, it is preferred that extending lines E2–E5 of second through fifth strings 12–15 pass through the point X. The point X can be determined by finding an angle ($\sigma$) of inclination of the first string 11, an angle ($\sigma' \approx \sigma$) of inclination of the sixth string 16, and further, a distance (d) between the first string 11 and the sixth string 16 ($R0 \approx d/\tan \sigma$).

Each fret 24 is formed arcuately with the point X as a center point. Concretely, with measured value in the case of usual classic guitar as an example, a distance R0 from the point X along the extending line E1 of the first string 11 and the extending line E2 of the sixth string 16 to a zero fret F0 formed on an inside surface of the nut 22 is about 1365.82 mm. Furthermore, with an average calculated distance between the zero fret F0 and a first fret F1 for sharping a tone of about 35.02 mm, a curvature radius R1 of the first fret F1 is about 1400.84 mm. In the same way, in the case of a second fret F2, with an average calculated distance from the zero fret F0 to the second fret F2 for sharping a tone from the fret F1 of about 68.08 mm (about 33.06 mm from the first fret F1), a curvature radius R2 of the second fret F2 is about 1433.90 mm.

Thus, distances between each fret 24 (F1–F12) and the point X are distances Rp (R1–R12) calculated by adding each average calculated distance in turn, so that each curvature radius of the frets 24 (F1–F12) is the distance Rp.

Figures 3A, 3B:
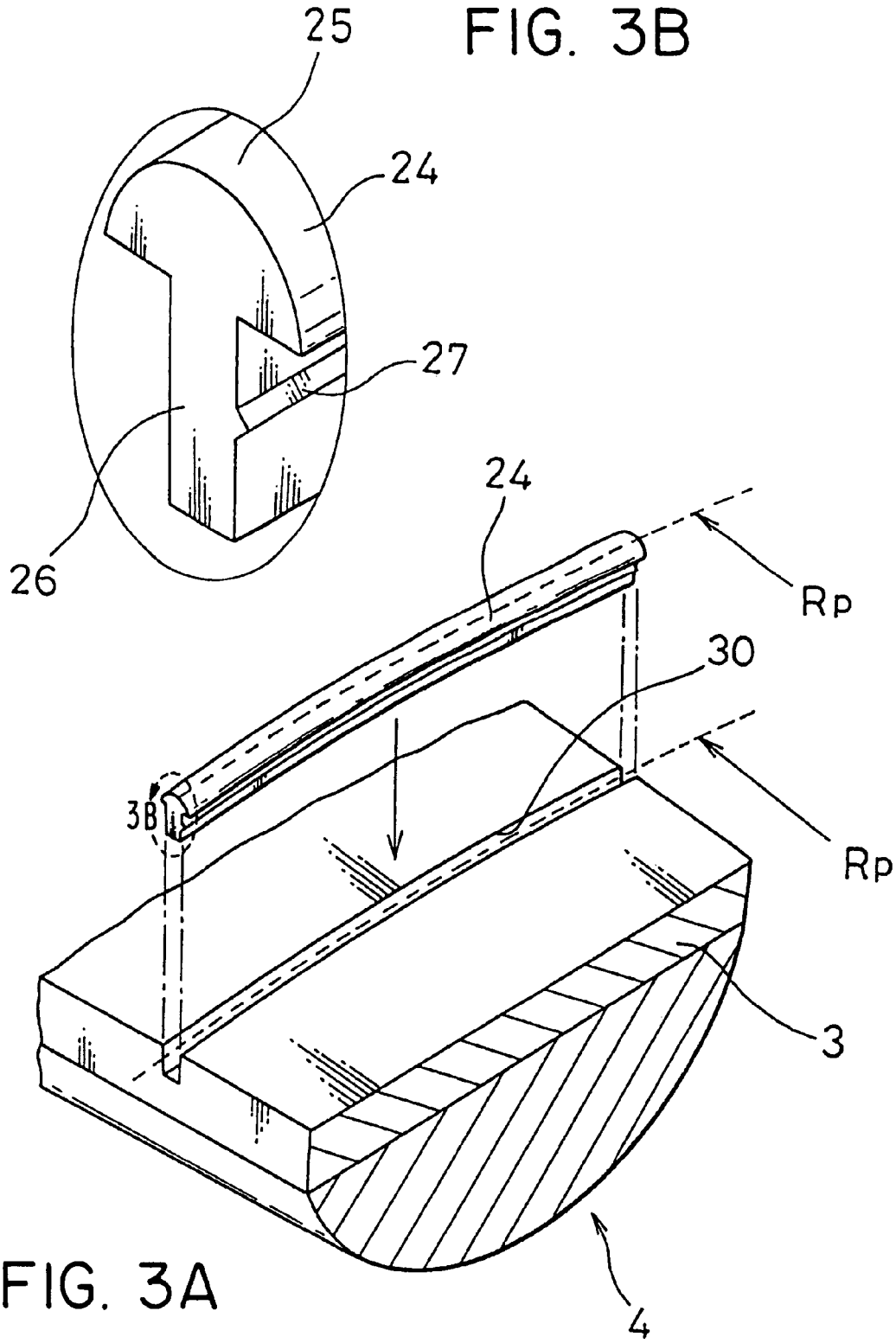
FIG. 3A is a schematic perspective view illustrating a fret and its mounting condition.
FIG. 3B is an enlarged view of a circled portion of FIG. 3A.

Usually, the fret 24 is, as shown in FIGS. 3A and 3B, constituted of a mountain portion 25 projecting from the finger plate 3 and whose cross section is approximately semicircular, a mounted portion 26 extending from a bottom chord portion of the mountain portion 25 and whose cross section is rectangular, and a projecting portion or projecting portions 27 formed in either side or both sides of the mounted portion 26, the fret 24 being formed arcuately with the specific curvature radius Rp. Each of the frets 24 is driven into each of mounting grooves 30 formed with the same curvature radius Rp.

Figure 4:
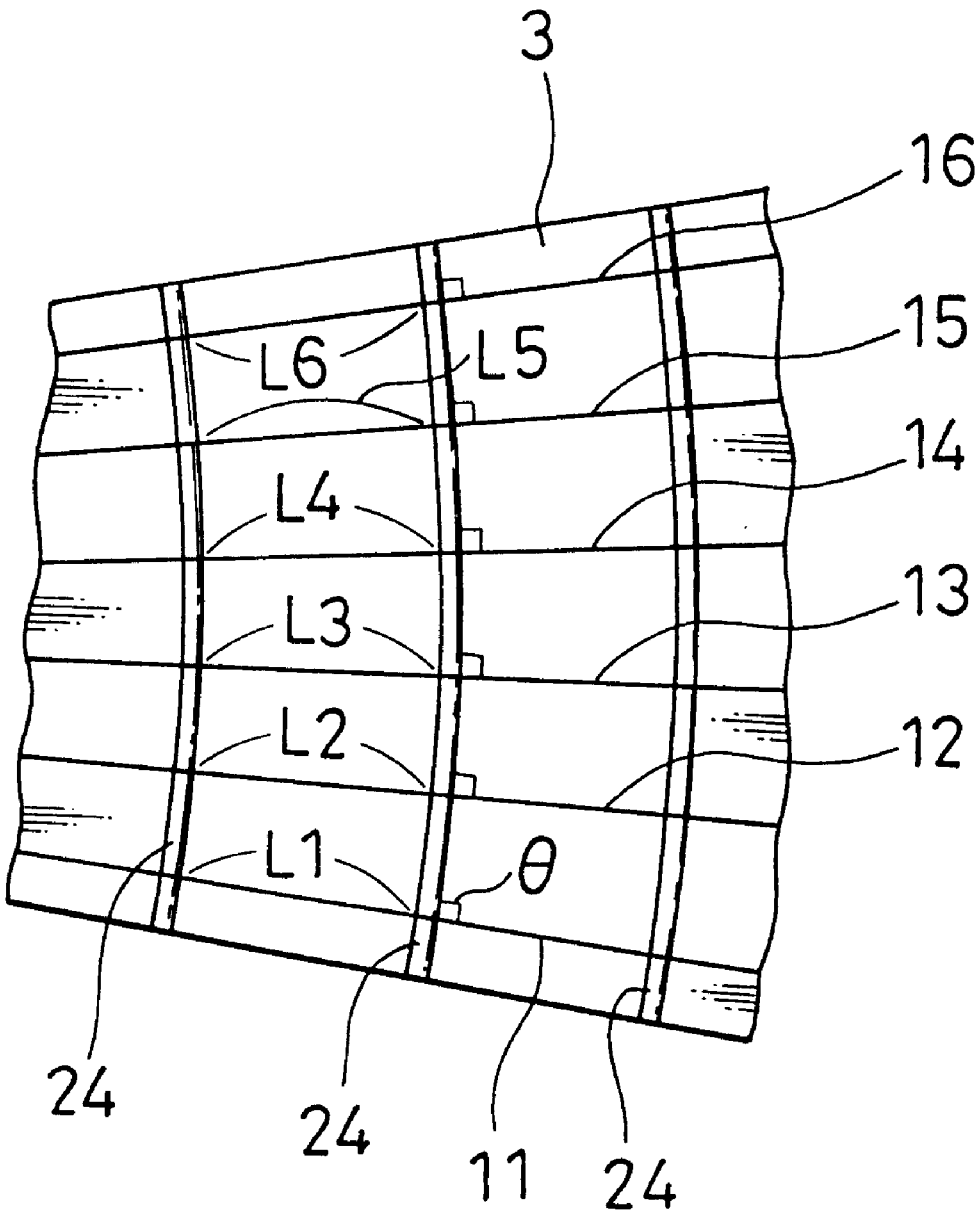
FIG. 4 is an illustration showing a portion of the guitar exaggerated in order to explain effects of the present invention.
Figure 5:
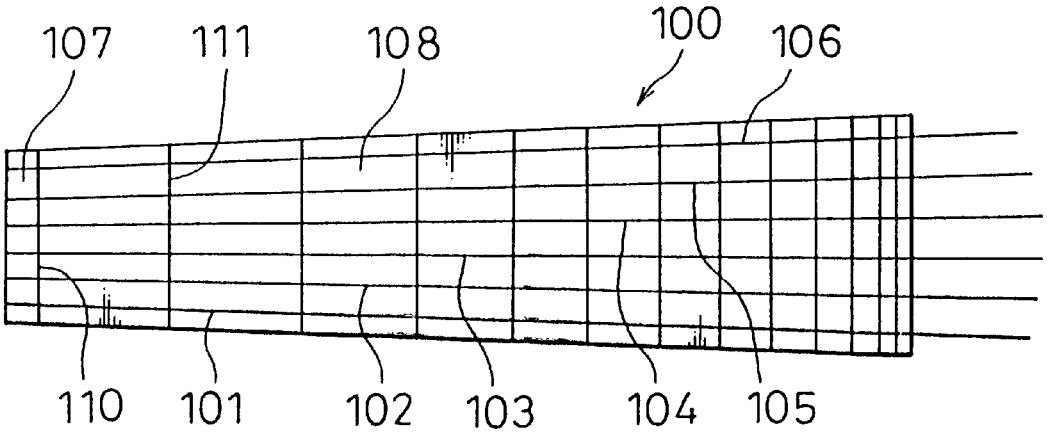
FIG. 5 PRIOR ART
FIG. 5 is a schematic diagram illustrating a prior finger plate.
Figure 6:
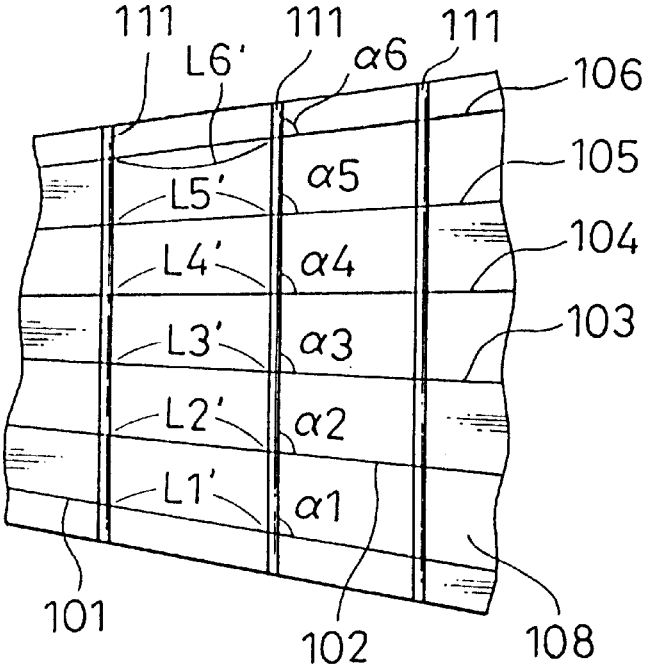
FIG. 6 PRIOR ART
FIG. 6 is an illustration deformed in order to illustrate the prior fret constitution.

Because the mounting grooves 30 are formed arcuately, resistance against deformation such as warping or twisting of the neck portion 4 and the finger plate 3 by tension of the strings 11–16 can be increased relative to the prior grooves formed in parallel to one another. Furthermore, as shown in FIG. 4, lengths L1–L6 of the strings 11–16 between adjacent frets 24 can be made equal, and each string 11–16 can cross every fret 24 perpendicularly ($\theta$=90°).

As explained above, according to the present invention, each fret is formed arcuately and has a center of curvature at a position at which extending lines of the strings passes intersect, so that lengths of the strings between adjacent frets can be made equal and each string crosses every fret perpendicularly. As a result, exact musical interval accuracy is achieved.

Furthermore, balances between the strings can be held constant by making the load (tension) of each string constant, so that tuning of the strings can be made easy.

Moreover, because every string crosses every fret perpendicularly, normal vibration of each string is gained, so that tone quality can be maintained.

Because mounting grooves are formed correspondingly to shapes of the frets, resistance against deformation such as warping or twisting due to tension of the strings is increased remarkably as compared with prior mounting grooves formed in parallel with one another, so that the deformation due to the tension of strings due to playing and drying with aging is controlled. As a result, stable playing conditions can be maintained.

As many apparently widely different embodiments of this invention may be made without departing from the spirit and scope thereof, it is to be understood that the invention is not limited to the specific embodiments thereof except as defined in the appended claims.

What is claimed is:

1. A finger plate for a stringed instrument, comprising:

a finger plate main body;

a nut positioned at one end portion of said finger plate main body for holding first ends of a plurality of strings having their second ends held by a saddle so as to extend along said finger plate main body in an extending direction thereof;

a plurality of frets disposed successively along the extending direction of said finger plate main body;

wherein each of said frets is formed arcuately to have a center of curvature at a position to coincide with a point of intersection of extension lines of at least two strings of the plurality of strings; and wherein each of said frets is arranged to cross all of the plurality of strings at right angles.

2. A finger plate according to claim 1, wherein said finger plate main body has a plurality of arcuate mounting grooves formed therein, and said frets are mounted in said mounting grooves, respectively.

3. A finger plate according to claim 2, wherein each fret is located along the extending direction of said finger plate main body at a position determined according to each temperament from a zero fret constituted by an inside surface of said nut.

4. A finger plate according to claim 1, wherein each fret is located along the extending direction of said finger plate main body at a position determined according to each temperament from a zero fret constituted by an inside surface of said nut.

5. A stringed instrument apparatus comprising:

a finger plate main body;

a nut positioned at one end portion of said finger plate main body for holding first ends of a plurality of strings extending along said finger plate main body in an extending direction thereof;

a saddle positioned to hold second ends of the plurality of strings;

a plurality of frets disposed successively along the extending direction of said finger plate main body;

wherein each of said frets is formed arcuately to have a center of curvature at a position to coincide with a point of intersection of extension lines of at least two strings of the plurality of strings; and wherein each of said frets is arranged to cross all of the plurality of strings at right angles.

6. A stringed instrument apparatus according to claim 5, wherein said finger plate main body has a plurality of arcuate mounting grooves formed therein, and said frets are mounted in said mounting grooves, respectively.

7. A stringed instrument apparatus according to claim 6, wherein each fret is located along the extending direction of said finger plate main body at a position determined according to each temperament from a zero fret constituted by an inside surface of said nut.

8. A stringed instrument apparatus according to claim 5, wherein each fret is located along the extending direction of said finger plate main body at a position determined according to each temperament from a zero fret constituted by an inside surface of said nut.

9. A stringed instrument apparatus according to claim 5, further comprising the plurality of strings held at the first ends thereof by said nut and held at the second ends thereof by said saddle; and wherein said strings all cross each of said frets at right angles.

10. A stringed instrument apparatus according to claim 9, wherein said saddle is wider than said nut.

11. A stringed instrument apparatus according to claim 5, wherein said saddle is wider than said nut.

12. A guitar apparatus comprising:

a finger plate main body;

a nut positioned at one end portion of said finger plate main body for holding first ends of a plurality of strings extending along said finger plate main body in an extending direction thereof;

a saddle positioned to hold second ends of the plurality of strings;

a plurality of frets disposed successively along the extending direction of said finger plate main body;

wherein each of said frets is formed arcuately to have a center of curvature at a position to coincide with a point of intersection of extension lines of at least two strings of the plurality of strings; and wherein each of said frets is arranged to cross all of the plurality of strings at right angles.

13. A guitar apparatus according to claim 12, wherein said finger plate main body has a plurality of arcuate mounting grooves formed therein, and said frets are mounted in said mounting grooves, respectively.

14. A guitar apparatus according to claim 13, wherein each fret is located along the extending direction of said finger plate main body at a position determined according to each temperament from a zero fret constituted by an inside surface of said nut.

15. A guitar apparatus according to claim 12, wherein each fret is located along the extending direction of said finger plate main body at a position determined according to each temperament from a zero fret constituted by an inside surface of said nut.

16. A guitar apparatus according to claim 12, further comprising the plurality of strings held at the first ends thereof by said nut and held at the second ends thereof by said saddle; and wherein said strings all cross each of said frets at right angles.

17. A guitar apparatus according to claim 16, wherein said saddle is wider than said nut.

18. A guitar apparatus according to claim 12, wherein said saddle is wider than said nut.

* * * * *